United States Patent [19]

Yoshioka et al.

[11] Patent Number: 4,732,128

[45] Date of Patent: Mar. 22, 1988

[54] METHOD AND APPARATUS FOR CONTROLLING HEATER FOR HEATNG AIR-FUEL RATIO SENSOR

[75] Inventors: Mamoru Yoshioka; Kenichi Nomura; Kouichi Hoshi; Takahide Izutani, all of Susono, Japan

[73] Assignee: Toyota Jidosha Kabushiki Kaisha, Toyota, Japan

[21] Appl. No.: 10,005

[22] Filed: Feb. 2, 1987

[30] Foreign Application Priority Data

Feb. 1, 1986 [JP] Japan ..... 61-19193

[51] Int. Cl.[4] ..... F02B 3/00

[52] U.S. Cl. ..... 123/440; 123/489

[58] Field of Search ..... 123/440, 489; 204/195 S

[56] References Cited

U.S. PATENT DOCUMENTS 4,303,613 12/1981 Yasuda ..... 123/440
4,354,468 10/1982 Sone ..... 123/440
4,359,030 11/1982 Sone ..... 204/195 S
4,538,575 9/1985 Chujo ..... 123/440
4,611,562 9/1986 Nakano ..... 123/440

*Primary Examiner*—Ronald B. Cox
*Attorney, Agent, or Firm*—Cushman, Darby & Cushman

[57] ABSTRACT

In an internal combustion engine, a heater for heating an air-fuel ratio sensor provided in the exhaust gas flow passage is controlled in accordance with a parameter of a load of the engine. That is, the heater is turned ON when the load parameter is not larger than a predetermined value, and the heater is turned OFF when the load parameter is larger than the predetermined value. The turning OFF of the heater is delayed with a predetermined delay time when the engine rotational speed is lower than a predetermined value, and the turning ON of the heater is delayed with the predetermined delay time when the engine rotational speed is higher than the predetermined value. Thus, the number of times that the heater is turned ON and OFF is decreased, thereby prolonging the life of the heater.

10 Claims, 12 Drawing Figures

METHOD AND APPARATUS FOR CONTROLLING HEATER FOR HEATNG AIR-FUEL RATIO SENSOR

BACKGROUND OF THE INVENTION (1) Field of the Invention

The present invention relates to a method and apparatus for controlling a heater for heating an air-fuel ratio sensor, such as an $O_2$ sensor. Such a sensor is used in an internal combustion engine for measuring the air-fuel ratio in the exhaust gas.

(2) Description of the Related Art

Generally, in a feedback control of the air-fuel ratio sensor (for example, an $O_2$ sensor) system, a based fuel amount is calculated in accordance with the detected intake air amount and engine rotational speed, and the base fuel amount is corrected by an air-fuel ratio coefficient calculated in accordance with the output signal of an air-fuel ratio sensor used to detect the concentration of a specific component, such as oxygen, in the exhaust gas. Thus, an actual fuel amount is controlled in accordance with corrected fuel amount. The above-mentioned process is repeated so that the air-fuel ratio of the engine is brought close to a stoichiometric air-fuel ratio.

Note, an output signal of an oxygen-battery-type $O_2$ sensor, which shows a rich or lean air-fuel ratio, is stable when the temperature of the element of the $O_2$ sensor is higher than a definite value. That is, the $O_2$ sensor is in an inactive state when the temperature of the element thereof is lower than a definite value, and the $O_2$ sensor is in an active state when the temperature of the element thereof is higher than a definite value. When the $O_2$ sensor is in an active state, it is possible to distinguish whether the air-fuel ratio is rich or lean by comparing the output voltage of the $O_2$ sensor with a definite value, for example, 0.45 V.

A method of keeping the $O_2$ sensor in an active state by the incorporation of a heater therein is already known. In the above mentioned $O_2$ sensor system, if the $O_2$ sensor is disposed in the exhaust gas flow passage, the heater is turned ON and OFF in accordance with a load parameter of the engine, such as the amount of intake airflow.

Nevertheless, when the heater is turned ON and OFF in accordance with the load parameter of the engine, the heater is frequently switched from ON to OFF or vice versa when the engine is driven at the boundary of a heater ON area and a heater OFF area determined by the load parameter, or when a gear-change is made. This often leads to conditions wherein the heater is frequently switched from ON to OFF or vice versa, and if the number of times that the heater is switched exceeds five hundred thousand within the lifetime of the engine, the wiring of the heater may be damaged beyond repair. In this case, the heater will be rendered inoperable, but the air-fuel ratio will be still controlled according to the output signal of the $O_2$ sensor, even though the $O_2$ sensor is in an inactive condition, thus deteriorating the driveability of the vehicle, and the emission characteristics and the fuel consumption of the engine.

SUMMARY OF THE INVENTION

It is an object of the present invention to provide a method and apparatus for controlling a heater for the heating of an air-fuel ratio sensor ($O_2$ sensor) in an internal combustion engine in which the lifetime of the heater is improved.

According to the present invention, a heater for heating an air-fuel ratio sensor provided in an exhaust gas flow passage is controlled in accordance with a load parameter of the engine. That is, the heater for the air-fuel ratio sensor is turned ON when the load parameter of the engine is not larger than a predetermined value, and is turned OFF when the load parameter is larger than the predetermined value. The turning OFF of the heater is delayed by a predetermined delay time when the engine rotational speed is lower than a predetermined value, and the turning ON of the heater is delayed by a predetermined delay time when the engine rotational speed is higher than a predetermined value.

Thus, the number of times that the heater is turned ON and OFF is decreased, thereby prolonging the life of the heater for the air fuel ratio sensor.

BRIEF DESCRIPTION OF THE DRAWINGS

The present invention will be more clearly understood from the description as set forth below with reference to the accompanying drawings, wherein.

DESCRIPTION OF THE PREFERRED EMBODIMENTS

Figure 1:
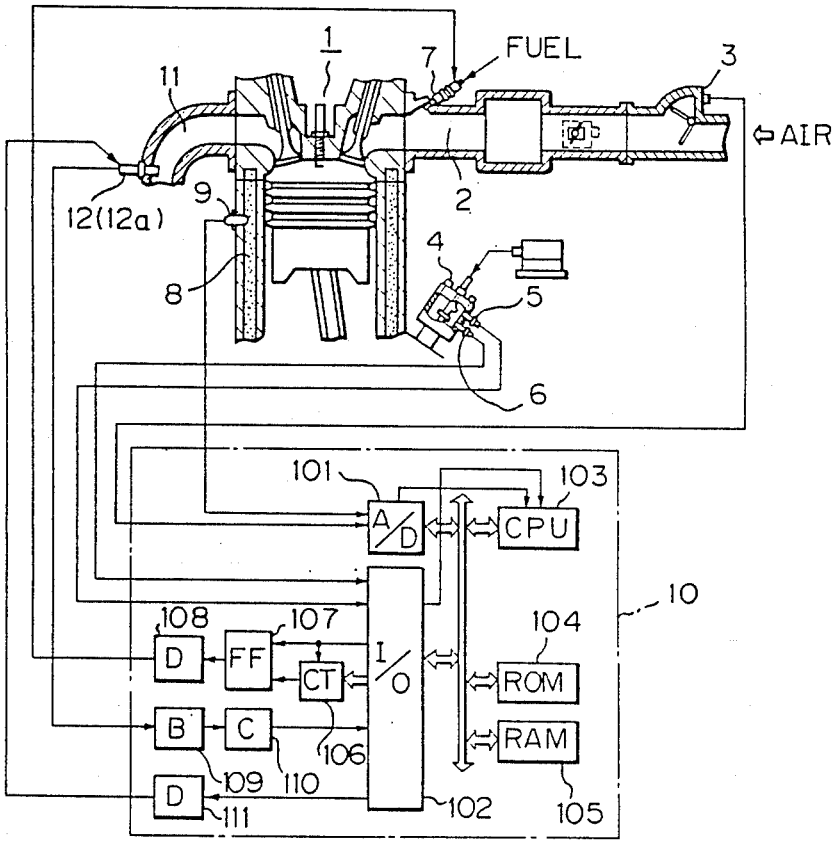
FIG. 1 is a schematic diagram of an internal combustion engine according to the present invention.

In FIG. 1, which illustrates an internal combustion engine according to the present invention, reference numeral 1 designates a four-cycle spark ignition engine disposed in an automotive vehicle. Provided in an air-intake passage 2 of the engine 1 is a potentiometer-type airflow sensor 3 for detecting the amount of air taken into the engine 1, to generate an analog voltage signal in proportion to the amount of air flowing therethrough. The signal of the airflow meter 3 is transmitted to a multiplexer-incorporating analog-to-digital (A/D) converter 101 of a control circuit 10.

Disposed in a distributor 4 are crank angle sensors 5 and 6 for detecting the angle of the crankshaft (not shown) of the engine 1. In this case, the crankangle sensor 4 generates a pulse signal at every 720° crank angle (CA) and the crank-angle sensor 6 generates a pulse signal at every 30° CA. The pulse signals of the crank sensors 5 and 6 are supplied to an input/output (I/O) interface 102 of the control circuit 10. In addition, the pulse signal of the crank angle sensor 6 is then supplied to an interruption terminal of a central processing unit (CPU) 103.

Additionally provided in the air-intake passage 2 is a fuel injection valve 7 for supplying pressurized fuel from the fuel system to the air-intake port of the cylinder of the engine 1. In this case, other fuel injection valves are also provided for other cylinders, not shown in FIG. 1.

Disposed in a cylinder block 13 of the engine 1 is a coolant temperature sensor 9 for detecting the temperature of the coolant 8. The coolant temperature sensor 9 generates an analog voltage signal in response to the temperature of the coolant and transmits that signal to the A/D converter 101 of the control circuit 10.

Provided in an exhaust gas passage 11 of the engine 1 is an $O_2$ sensor 12 for detecting the concentration of oxygen composition in the exhaust gas. The $O_2$ sensor 12 has a heater 12*a* (not shown) and a sensor element, and the heater warms the element when the temperature of the exhaust gas is low. The $O_2$ sensor 12 generates an output voltage signal and transmits the signal to the A/D converter 101 of the control circuit 10. The current control of the heater 12*a* is activated by the driver circuit of the control circuit 10.

The control circuit 10, which may be constructed by a microcomputer, further comprises a read-only memory (ROM) 104 for storing a main routine, interrupt routines such as a fuel injection routine, an ignition timing routine, tables (maps), constants, etc., a random access memory 105 (RAM) for storing temporary data, a down counter 106, a flip-flop 107, a driver circuit 108, a buffer circuit 109, a comparison circuit 110, and the like.

The down counter 106, the flip-flop 107, and the driver circuit 108 are used for controlling the fuel injection amount TAU calculated in a TAU routine, the amount TAU is preset in the down counter 106, and simultaneously, the flip-flop 107 is set. As a result, the driver circuit 108 initiates the activation of the fuel injection valve 7. On the other hand, the down counter 106 counts up the clock signal from the clock generator (not shown), and finally generates a logic "1" signal from the carry-out terminal thereof, to reset the flip-flop 107, so that the driver circuit 108 stops the activation of the fuel injection valve 7. Thus, the amount of fuel corresponding to the fuel injection amount TAU is injected into the fuel injection valve 7.

Interruptions occur at the CPU 103 when the A/D converter 101 completes an A/D conversion and generates an interrupt signal, when the crank angle sensor 6 generates a pulse signal, and when the clock generator generates a special clock signal.

The intake air amount data Q of the airflow sensor 3 is fetched by an A/D conversion routine(s) executed at every predetermined time period and is then stored in the RAM 105. That is, the data Q in the RAM 105 is renewed at every predetermined time period. The engine speed Ne is calculated by an interrupt routine executed at 30° CA, i.e., at every pulse signal of the crank angle sensor 6, and is then stored in the RAM 105.

Figure 2:
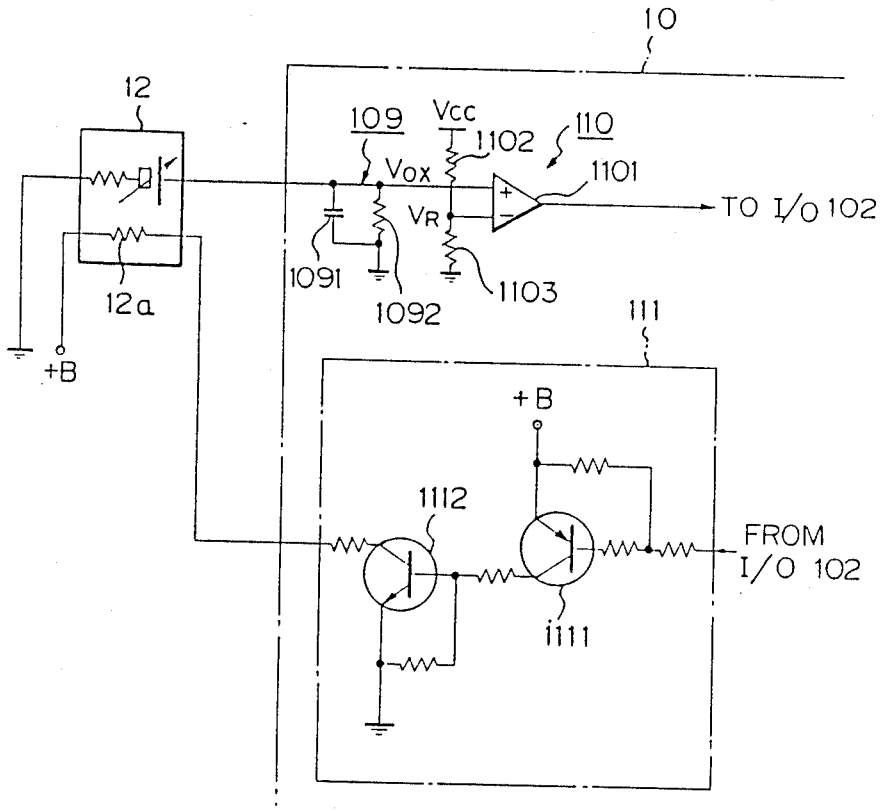
FIG. 2 is a detailed circuit diagram showing a part of control circuit of FIG. 1.

FIG. 2 shows a part of the control circuit 10 and the $O_2$ sensor of FIG. 1. A buffer circuit 109 includes a capacitor 1091 and a resistor 1092, and a comparison circuit 110 includes an operational amplifier 1101 and resistors 1102 and 1103, and generates a reference voltage VR (=0.45 V) and transmits it to an inverted input of the operational amplifier 1101. The resistor 1092 is used for limiting the maximum output level of the $O_2$ sensor 12 when the temperature of the element of the $O_2$ sensor is too high.

That is, an output signal of the $O_2$ sensor 12 is once stored in the buffer circuit 109, and is then converted into a digital signal by the comparison circuit 110. This digital signal is transmitted to an I/O interface 102 for an air-fuel ratio feedback control. Note that Vcc indicates an supply voltage of the control circuit 10, for example, 5 V.

A driver circuit 111 consists of serially-connected transistors 1111 and 1112. Reference +B is a battery voltage such as 12 V. When the output signal of the I/O interface 102 is low, the power transistors 1111 and 1112 are both turned ON and the heater 12*a* is turned ON. On the other hand, when the output signal of the I/O interface 102 is high, the power transistors 1111 and 1112 are turned OFF and the heater 12*a* turned OFF.

Figure 3:
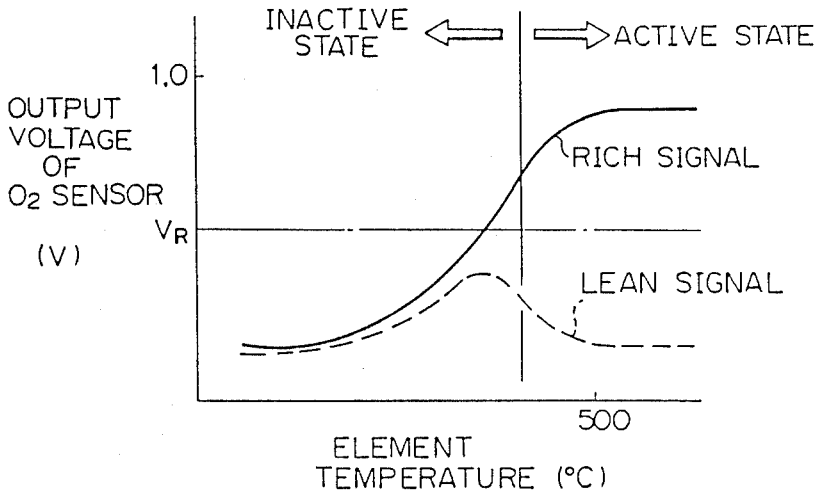
FIG. 3 to FIG. 6 are graphs explaining the principle of the present invention.

FIG. 3 shows the relationship between the output voltage and the element temperature of the $O_2$ sensor 12. When the air-fuel ratio is rich, a rich signal from the $O_2$ sensor increases in accordance with the temperature of the element of the $O_2$ sensor, to become stable at a high level. On the other hand, when the air-fuel ratio is lean, a lean signal from the $O_2$ sensor once increases in accordance with the temperature of the element of the $O_2$ sensor, but decreases in accordance with the decrease of the temperature of the element of the $O_2$ sensor 12 to become stable at a low level. That is, the $O_2$ sensor comes to an active state or an inactive state in accordance with the temperature of the element, and accordingly, the operation range of the $O_2$ sensor 12 is limited.

Figure 4:
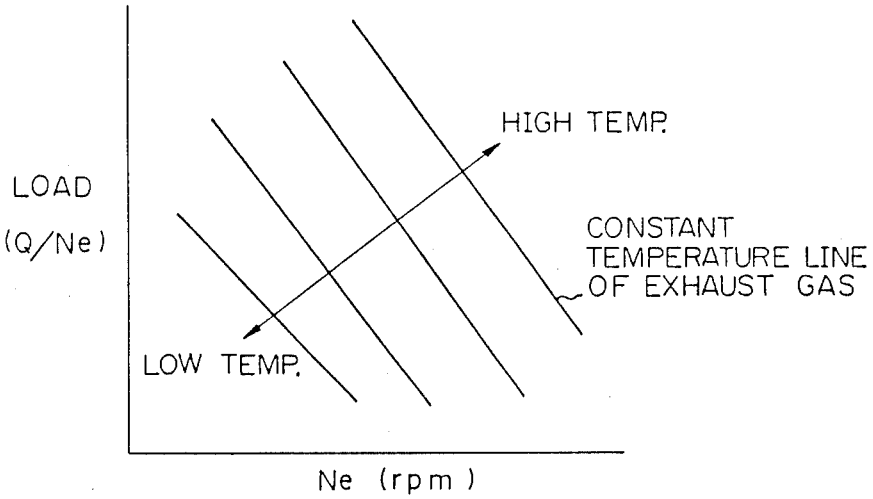

FIG. 4 shows the temperature of the exhaust gas in relation to an engine rotational speed Ne and a load such as an intake air amount Q/Ne per one engine revolution. Note that the temperature of the exhaust gas of the engine closely corresponds to the temperature of the $O_2$ sensor element.

Figure 5:
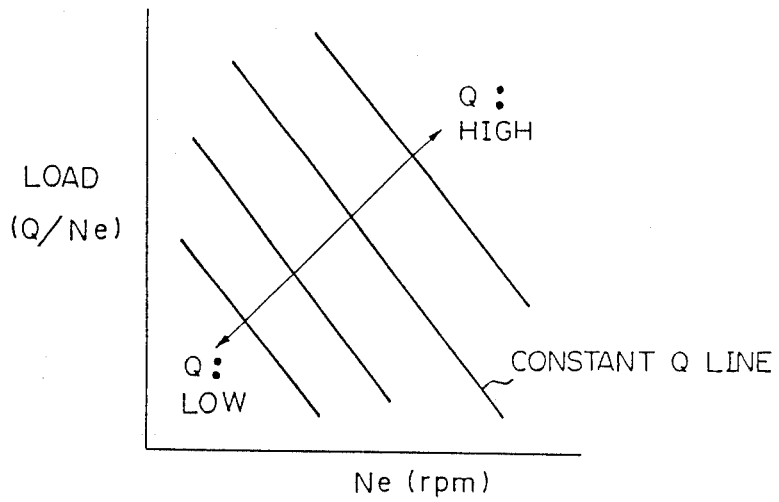

On the other hand, FIG. 5 shows the intake air amount in relation to the engine rotational speed Ne and the load Q/Ne. As shown in FIG. 4 and FIG. 5 the temperature of the exhaust gas depends on the intake air amount and, therefore, it can be understood that the temperature of the $O_2$ sensor element also depends on the amount of intake air.

Figure 6:
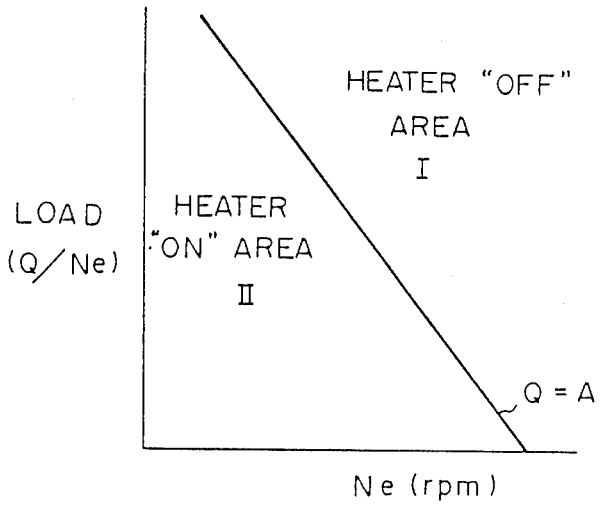

In the present invention, the temperature of the $O_2$ sensor element is indirectly detected by the intake air amount Q. As shown in FIG. 6, a heater OFF area I and a heater ON area II are divided by a line at which Q=A. When the intake air amount Q is in the area II, the heater 12*a* is turned ON. Conversely, when the intake air amount Q is in the area I, the heater 12*a* is turned OFF. When the intake air amount Q changes from the area II to the area I, the heater 12*a* is turned OFF with a delay time, and when the intake air amount Q changes from the area I to the area II, the heater 12*a* is turned ON with a delay time.

The operation of the control circuit 10 of FIG. 1 will be explained with reference to the flowchart of FIG. 7.

Figure 7:
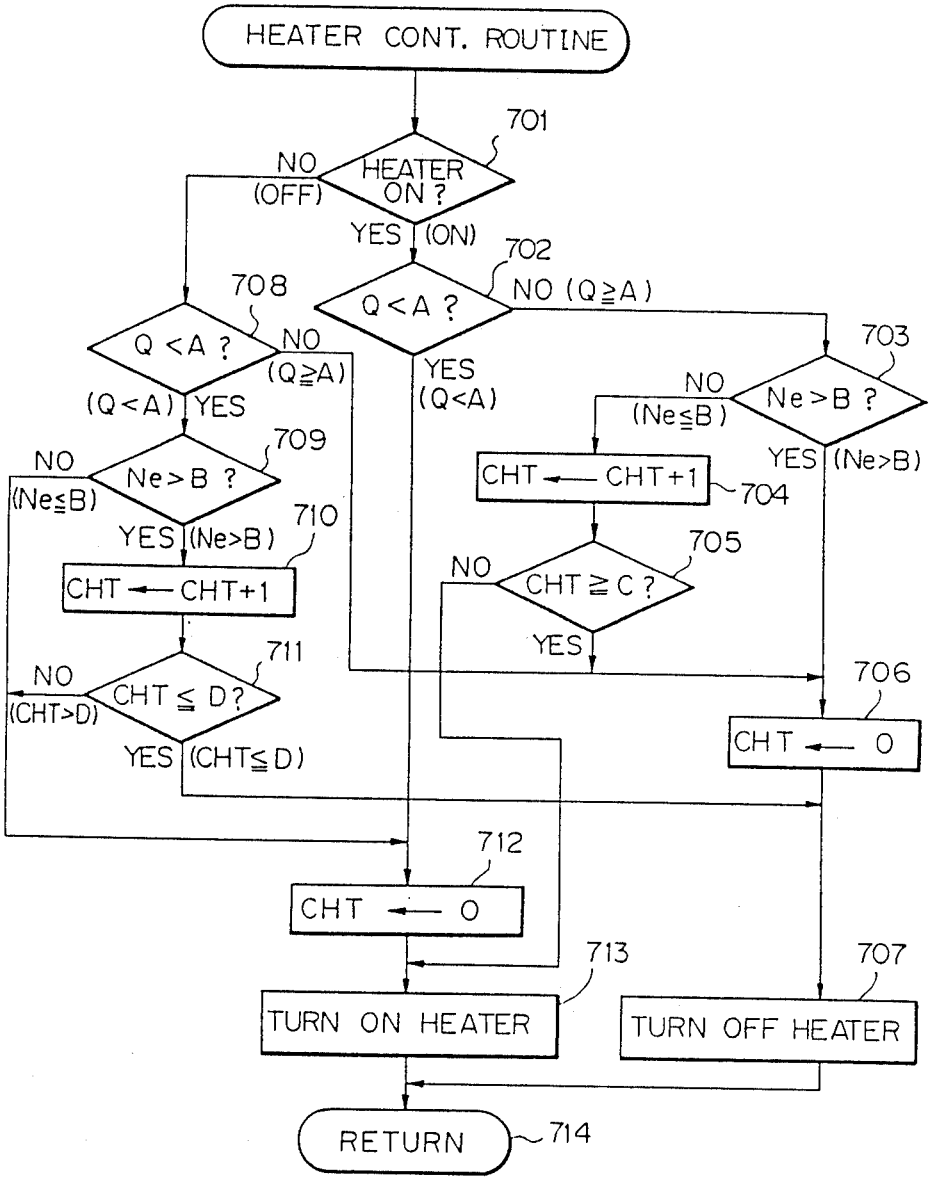
FIG. 7 is a flowchart showing the operation of the control circuit of FIG. 1; and, FIGS. 8A, 8B, 8C, 8D and 8E are waveforms related to the explanation of the flowchart of FIG. 7.

FIG. 7 shows a routine for controlling the heater 12*a* executed at every predetermined time period such as 500 ms. At step 701, it is determined whether or not the heater is ON. If the heater is not ON, i.e., OFF (NO), the control proceeds to step 708, and if the heater is ON (YES), the control proceeds to step 702.

First, the case wherein the heater is ON will be explained. When the heater is ON, the control proceeds from step 701 to step 702. At step 702, the data of the intake air amount Q is read out of the RAM 105, and it is determined whether or not the intake air amount Q is smaller than a predetermined value A, such as 70 $m^3/h$. Note that the value A is constant in this embodiment, but that this value A is changeable in accordance with a load parameter of the engine, such as the intake air amount Q. If Q<A (YES) at step 702, i.e., if the heater is in the turn ON area II of FIG. 6, the control proceeds to step 712, which resets a delay counter CHT. The control then proceeds to step 713, whereby the input of the driver circuit 111 (FIG. 2) is made low level to turn ON the power transistors 1111 and 1112. Thus, the heater 12a is turned ON and the routine is completed at step 714.

If Q≧A (NO) at step 702, i.e., if the heater is in the turn OFF area I of FIG. 6, the control proceeds to step 703, at which it is determined whether or not the engine rotational speed Ne is larger than a predetermined value B, such as 3000 rpm. If Ne>B (YES) at step 703, the control proceeds to step 706, and resets the delay counter CHT. In this case, since Q≧A and Ne>B, the $O_2$ sensor 12 is in an active state and it is not necessary for the $O_2$ sensor 12 to be heated by the heater 12a. As a result, the control proceeds to step 707, whereby the input of the driver circuit 111 (FIG. 2) is made high level to turn OFF the power transistors 1111 and 1112. Thus, the heater 12a is turned OFF and the routine is completed at step 714.

Contrary to the above, if Ne≦B (NO) at step 703, the control proceeds to step 704 to delay the turn OFF of the heater. In this case, since Q≧A but Ne ≦B, the $O_2$ sensor 12 is in an inactive state and it is necessary for the $O_2$ sensor 12 to be heated by the heater 12a. As a result, at step 704 and step 705, the ON state of the heater 12a is maintained by incrementing the delay counter CHT. Namely, at step 704, the counter CHT is increased by 1, and at step 705, it is determined whether or not the value of the counter CHT is larger than a predetermined delay time value C, such as 6 (=3s). If CHT<C (NO), the control proceeds to step 713 and turns ON the heater 12a. Then the routine is completed at step 714. But, if CHT becomes larger than C (YES) at step 705, the control proceeds to step 706, and resets the delay counter CHT. The control then proceeds to step 707, which turns OFF the heater 12a. This routine is completed at step 714.

Next, the case wherein the heater is in the OFF state is explained. When the heater is OFF, the control proceeds to step 708 from step 701. At step 708, the data of the intake air amount Q is read out of the RAM 105, and it is determined whether or not the intake air amount Q is smaller than the predetermined value A. If Q≧A (NO) at step 708, i.e., the heater is in the turn OFF area I of FIG. 6, the control proceeds to step 706, and resets the delay counter CHT. The control then proceeds to step 707, to turn OFF the heater 12a, and the routine is completed at step 714.

If Q<A (NO) at step 708, i.e., the heater is in the turn ON area II of FIG. 6, the control proceeds to step 709 in which it is determined whether or not the engine rotational speed Ne is larger than the predetermined value B. If Ne≦B (NO) at step 709, the control proceeds to step 712, and resets the delay counter CHT. In this case, since Q<A and Ne≦B, the $O_2$ sensor 12 is in an inactive state and it is necessary for the $O_2$ sensor 12 to be heated by the heater 12a. As a result, the control proceeds to step 712, and resets the delay counter CHT. The control then proceeds to step 713, and the heater 12a is turned ON. The routine is then completed at step 714.

Contrary to the above, if Ne<B (YES) at step 709, the control proceeds to step 710, so that the turn ON of the heater is delayed against a temporary deceleration of the vehicle. In this case, since Q<A but Ne>B, the $O_2$ sensor 12 is likely to be in an active state and it is not necessary for the $O_2$ sensor 12 to be heated by the heater 12a. As a result, at steps 710 and 711, the OFF state of the heater 12a is maintained. Namely, at step 710, the counter CHT is incremented by 1, and at step 711, it is determined whether or not the value of the counter CHT is smaller than a predetermined delay time value D, such as 10 (=5s). If CHT≦D (YES), the control proceeds to step 707 which turns OFF the heater 12a. Then, the routine is completed at step 714. But, if CHT becomes larger than D (NO) at step 711, the control proceeds to step 712, which resets the delay counter CHT. The control then proceeds to step 712, and turns ON the heater 12a. This routine is completed at step 714.

Note that, when the heater is in an OFF state or an ON state, the same value A is used in both cases to determine whether the intake air amount Q is large or small. In this embodiment, the value A may be different according to whether the heater 12a is in an OFF state or an ON state. Similarly, the value B may be different according to whether the heater 12a is in an OFF state or an ON state. Further, although the delay time value D is larger than the delay time value C in this embodiment, the value C may be the same as the value D, or the value D may be smaller than the value C. Also, although the values D and C are constant in this embodiment, the values C and D are changeable in accordance with a load parameter of the engine, a temperature of the coolant, and a speed of the vehicle.

Figure 8A:
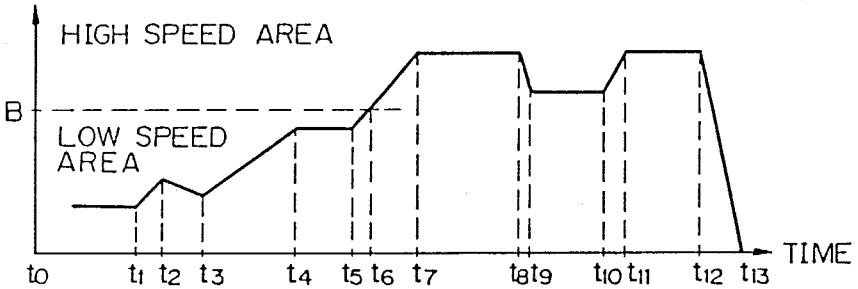

The flowchart of FIG. 7 will be explained in more detail with reference to FIGS. 8A, 8B, 8C, 8D, and 8E. In FIG. 8A which shows the change of the running mode of the vehicle, the abscissa indicates time and the ordinate indicates the engine rotational speed Ne. Here, B=3000 rpm. In this embodiment, the area above the level B is called a high speed area, and the area below the level B is called a low speed area. The running mode of the vehicle as shown in FIG. 8A is as follows:

t0~t1 . . . constant running state of the vehicle at the low speed area;
t1 ~t2 . . . acceleration state of the vehicle at the low speed area;
t2 ~t3 . . . deceleration state of the vehicle at the low speed area;
t3 ~t4 . . . acceleration state of the vehicle at the low speed area;
t4 ~t5 . . . constant running state of the vehicle at the low speed area;
t5 ~t6 . . . acceleration state of the vehicle at the low speed area;
t6 ~t7 . . . acceleration state of the vehicle at the high speed area;
t7 ~t8 . . . constant running state of the vehicle at the high speed area;
t8 ~t9 . . . deceleration state of the vehicle at the high speed area;
t9 ~t10 . . . constant running state of the vehicle at the high speed area;
t10 ~t11 . . . acceleration state of the vehicle at the high speed area;
t11 ~t12 . . . constant running state of the vehicle at the high speed area; and
t12 ~t13 . . . deceleration state of the vehicle at the high speed area.

Figure 8B:
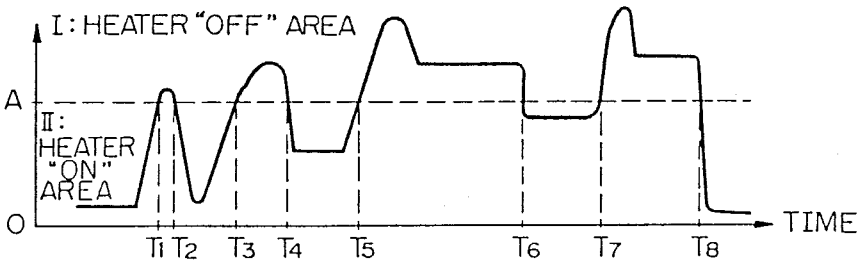

FIG. 8B shows the intake air amount Q in accordance with the running condition of the vehicle, as shown in FIG. 8A. In FIG. 8B, the value A is 70 $m^3/h$ as explained in FIG. 7. Accordingly, an upper area above the level A shows a heater OFF area, and a lower area below the level A shows a heater ON area. Accordingly, at time T1, T3, T5, and T7, the determination at step 702 of FIG. 7 is negative, and at time T2, T4, T6, and T8, the determination at step 708 of FIG. 7 is affirmative.

Figure 8C:
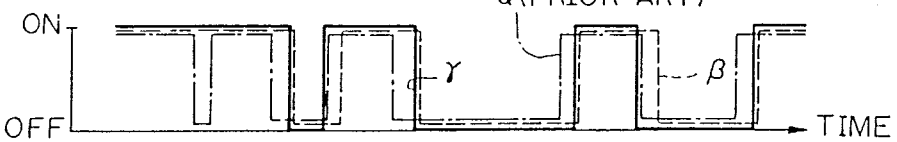
Figure 8D:
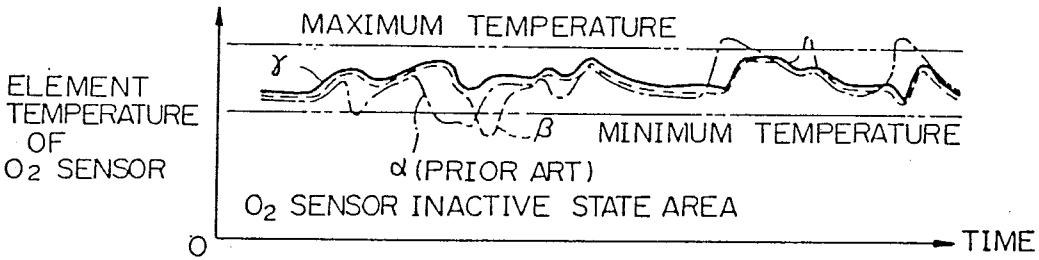
Figure 8E:
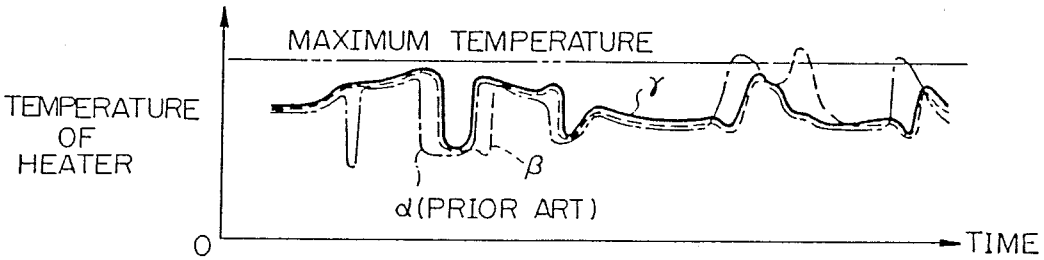

FIG. 8C shows the change of a heating signal for turning ON or OFF the heater, FIG. 8D shows the change of the temperature of the element of the $O_2$ sensor 12, and FIG. 8E shows the change of the temperature of the heater in accordance with the running condition of the vehicle as shown in FIG. 8A, as compared with the prior art. In FIGS. 8C, 8D, and 8E, a waveform $\alpha$ (dash and dotted line) shows the heating signal of the prior art, and a waveform $\beta$ (dotted line) and a waveform Y (solid line) show the heating signal of the present invention. If there is no delay time at a change of the heater from the ON state to the OFF state, and vice versa, the heating signal is shown by the waveform $\alpha$. If a delay time is imposed at every change of the heater from the ON state to the OFF state, and vice versa, the heating signal is shown by the waveform $\beta$.

When comparing the waveform $\alpha$ of the prior art with the waveform $\gamma$ of the present invention, it is understood number of times that the heater of the prior art is switched is larger than that of the present invention, so that the durability of the heater 12*a* in the prior art is reduced compared with the present invention. Also, it is understood from the waveform $\alpha$ of the prior art that the heater 12*a* soon turns OFF at time T1 and T3 of the low speed area of the vehicle, when it is necessary for the $O_2$ sensor 12 to be heated, and the heater 12*a* soon turns ON at time T6 and T8 of the high speed area of the vehicle, when it is not necessary for the $O_2$ sensor 12 to be heated. At time T1 and T3, the $O_2$ sensor 12 may become inactive (shown in FIG. 8D), and at time T6 and T8, the $O_2$ sensor 12 may be overheated, i.e. the temperature of the element of the $O_2$ sensor 12 may exceed the maximum temperature as shown in FIG. 8D.

When comparing the waveform $\beta$ with the waveform $\gamma$, it is understood that, at time T4 of the low speed area of the vehicle when it is necessary for the $O_2$ sensor 12 to be heated by the heater 12*a*, the turning ON of the heater 12*a* is delayed by the delay time, and at time T7 of the high speed area of the vehicle, it is necessary for the $O_2$ sensor 12 to be heated rapidly, nevertheless, the turning OFF of the heater 12*a* is actually delayed by the delay time. At time T4, the $O_2$ sensor 12 may become inactive (shown in FIG. 8D), and at time T7, the $O_2$ sensor 12 may be overheated, i.e., the temperature of the element of the $O_2$ sensor 12 may exceed the maximum temperature, as shown in FIG. 8D.

In the present invention, the turning OFF of the heater 12*a* is delayed at time T1, T3, and T5 when the $O_2$ sensor must be heated, but the turning OFF of the heater 12*a* is not delayed at time T7 when it is not necessary for the $O_2$ sensor to be heated. Also, in the present invention, the heater 12*a* is soon turned ON at time T4 when the $O_2$ sensor 12 must be heated, but the heater is turned ON with a delay time at time T6 when it is not necessary for the $O_2$ sensor 12 to be heated. In this embodiment, the delay time is longer than the period between time T1 and time T2.

Accordingly, the temperature of the element of the $O_2$ sensor 12 in the present invention remains between the maximum temperature and the minimum temperature of the temperature of the element of the $O_2$ sensor 12 as shown in FIG. 8D, so that the present invention can realize both a long lifetime and a stability of the $O_2$ sensor. Further, regarding the temperature of the heater 12*a*, it is possible for the temperature of the heater 12*a* in the prior art to exceed the maximum temperature, but the heater 12*a* in the present invention can not exceed the maximum temperature, as shown in FIG. 8E, so that the heater 12*a* in the present invention has a longer lifetime than the heater in the prior art.

We claim:

1. A method for controlling a heater for heating an air-fuel ratio sensor provided in an exhaust gas flow passage of an internal combustion engine comprising the steps of:

detecting a load parameter of said engine;

determining whether or not said load parameter is larger than a predetermined value;

detecting a rotational speed of said engine;

determining whether or not said rotational speed of said engine is larger than a predetermined value;

turning ON said heater when said load parameter is not larger than said predetermined value;

turning OFF said heater when said load parameter is larger than said predetermined value;

delaying the turning OFF of said heater with a predetermined delay time when said load parameter is larger than said predetermined value and said engine rotational speed is lower than said predetermined value; and delaying the turning ON of said heater with a predetermined delay time when said load parameter is not larger than said predetermined value and said engine rotational speed is higher than said predetermined value.

2. A method as set forth in claim 1, further comprising the steps of;

detecting a speed of a vehicle in which said engine is mounted;

changing said delay time in accordance with said load parameter of said engine and said vehicle speed.

3. A method as set forth in claim 1, wherein said load parameter is an intake air amount of said engine.

4. A method as set forth in claim 1, wherein said load parameter is an intake air pressure of said engine.

5. A method as set forth in claim 1, wherein said load parameter is a throttle opening of said engine.

6. An apparatus for controlling a heater for heating an air-fuel ratio sensor provided in an exhaust gas flow passage of an internal combustion engine comprising:

means for detecting a load parameter of said engine;

means for determining whether or not said load parameter is larger than a predetermined value;

means for detecting a rotational speed of said engine;

means for determining whether or not said rotational speed of said engine is larger than a predetermined value;

means for turning ON said heater when said load parameter is not larger than said predetermined value;

means for turning OFF said heater when said load parameter is larger than said predetermined value;

means for delaying the turning OFF of said heater with a predetermined delay time when said load parameter is larger than said predetermined value and said engine rotational speed is lower than said predetermined value; and means for delaying the turning ON of said heater with a predetermined delay time when said load parameter is not larger than said predetermined value and said engine rotational speed is higher than said predetermined value.

7. An apparatus as set forth in claim 6 further comprising:

means for detecting a speed of a vehicle in which said engine is mounted;

means for changing said delay time in accordance with said load parameter of said engine and said vehicle speed.

8. An apparatus as set forth in claim 7, wherein said load parameter is an intake air amount of said engine.

9. An apparatus as set forth in claim 7, wherein said load parameter is an intake air pressure of said engine.

10. An apparatus as set forth in claim 7, wherein said load parameter is a throttle opening of said engine.

* * * * *